US008302784B2

(12) United States Patent
Nagel et al.

(10) Patent No.: US 8,302,784 B2
(45) Date of Patent: Nov. 6, 2012

(54) PRODUCT DISPLAY TRAY WITH PULL THROUGH FEATURE

(75) Inventors: Thomas O. Nagel, Blairstown, NJ (US); Joseph F. Kologe, Scranton, PA (US)

(73) Assignee: Trion Industries, Inc., Wilkes-Barre, PA (US)

( * ) Notice: Subject to any disclaimer, the term of this patent is extended or adjusted under 35 U.S.C. 154(b) by 261 days.

(21) Appl. No.: 12/836,353

(22) Filed: Jul. 14, 2010

(65) Prior Publication Data

US 2011/0017684 A1 Jan. 27, 2011

Related U.S. Application Data

(60) Provisional application No. 61/228,051, filed on Jul. 23, 2009.

(51) Int. Cl.
*A47F 1/04* (2006.01)

(52) U.S. Cl. ..... 211/59.3; 221/279

(58) Field of Classification Search ..... 211/59.2, 211/59.3, 184, 72, 126.1, 126.16; 221/56, 221/198, 226, 279; 312/71, 72, 35; 108/61
See application file for complete search history.

(56) References Cited

U.S. PATENT DOCUMENTS 604,917 A * 5/1898 Hancock ..... 312/35
1,488,025 A * 3/1924 Poynter ..... 211/49.1
1,646,121 A * 10/1927 Thorp ..... 221/63
2,889,055 A * 6/1959 Weller et al. ..... 211/184
2,915,193 A * 12/1959 Bromberg ..... 108/61
3,110,402 A * 11/1963 Mogulescu ..... 211/59.3
4,730,741 A * 3/1988 Jackle et al. ..... 211/59.3
4,801,025 A * 1/1989 Flum et al. ..... 211/59.2
4,958,739 A * 9/1990 Spamer ..... 211/153
RE33,515 E * 1/1991 Fershko et al. ..... 211/49.1
4,997,094 A * 3/1991 Spamer et al. ..... 211/153
5,024,336 A * 6/1991 Spamer ..... 211/59.2
5,531,336 A * 7/1996 Parham et al. ..... 211/183
5,562,217 A * 10/1996 Salveson et al. ..... 211/59.3
5,634,564 A * 6/1997 Spamer et al. ..... 211/59.3
5,685,664 A * 11/1997 Parham et al. ..... 403/393
5,706,956 A * 1/1998 Headrick et al. ..... 211/59.2
5,788,091 A * 8/1998 Robertson et al. ..... 211/59.2
6,068,140 A * 5/2000 Mangrum et al. ..... 211/132.1
6,142,317 A * 11/2000 Merl ..... 211/59.3
6,460,710 B1 * 10/2002 Dardashti ..... 211/184
6,604,638 B1 * 8/2003 Primiano et al. ..... 211/59.2
6,779,670 B2 * 8/2004 Primiano et al. ..... 211/74
6,866,155 B2 * 3/2005 Nagel ..... 211/59.3
6,866,700 B2 3/2005 Amann (Continued)

*Primary Examiner* — Teri P. Luu
*Assistant Examiner* — Devin Barnett
(74) *Attorney, Agent, or Firm* — St. Onge Steward Johnston & Reens LLC

(57) ABSTRACT

A tray for the display and dispensing of products in blister packages. Side guide elements, of wire or sheet material, are provided in forward portions thereof with retaining elements formed integrally and in one piece therewith. The retaining elements engage side margins of a forwardmost package well below the tops of the packages and preferably below the tops of the blisters thereof. A forwardmost package is gripped by its exposed and unobstructed upper portions and pulled forwardly to remove a package. Integral, one-piece construction of the side guide elements and the retaining elements provides for economical manufacture with superior performance. Optionally, space may be provided in front of the retaining portions to accommodate return of packages by a customer who has changed his or her mind. In one embodiment, a wire retaining portion of inverted U-shaped configuration is positioned with wire ends concealed and protected by the tray side.

6 Claims, 7 Drawing Sheets

U.S. PATENT DOCUMENTS

| | | | | |
|---|---|---|---|---|
| 6,886,699 | B2 * | 5/2005 | Johnson et al. | 211/59.3 |
| 6,886,700 | B2 * | 5/2005 | Nagel | 211/59.3 |
| 6,889,855 | B2 * | 5/2005 | Nagel | 211/59.3 |
| 7,032,761 | B2 * | 4/2006 | Nagel | 211/59.3 |
| 7,195,123 | B2 | 3/2007 | Roslof et al. | |
| 7,681,745 | B2 * | 3/2010 | Richter | 211/59.3 |
| 7,854,334 | B2 * | 12/2010 | Nagel et al. | 211/59.3 |
| 2004/0000528 | A1 * | 1/2004 | Nagel | 211/59.3 |
| 2004/0004047 | A1 * | 1/2004 | Nagel et al. | 211/59.3 |
| 2004/0065631 | A1 * | 4/2004 | Nagel | 211/59.3 |
| 2004/0079715 | A1 * | 4/2004 | Richter et al. | 211/59.3 |
| 2005/0039640 | A1 * | 2/2005 | Ogden et al. | 108/61 |
| 2005/0092702 | A1 * | 5/2005 | Nagel | 211/59.3 |
| 2006/0260518 | A1 * | 11/2006 | Josefsson et al. | 108/61 |
| 2006/0273053 | A1 * | 12/2006 | Roslof et al. | 211/59.3 |
| 2007/0170127 | A1 * | 7/2007 | Johnson | 211/59.3 |
| 2007/0175839 | A1 * | 8/2007 | Schneider et al. | 211/59.3 |
| 2008/0142458 | A1 * | 6/2008 | Medcalf | 211/59.3 |
| 2008/0156752 | A1 * | 7/2008 | Bryson et al. | 211/59.3 |
| 2010/0012602 | A1 * | 1/2010 | Valiulis et al. | 211/59.3 |
| 2010/0032391 | A1 * | 2/2010 | Schneider et al. | 211/59.2 |
| 2010/0108623 | A1 * | 5/2010 | Virvo | 211/49.1 |
| 2010/0108624 | A1 * | 5/2010 | Sparkowski | 211/59.3 |
| 2010/0140197 | A1 * | 6/2010 | Schneider et al. | 211/59.3 |
| 2010/0176075 | A1 * | 7/2010 | Nagel et al. | 211/59.3 |
| 2010/0176077 | A1 * | 7/2010 | Nagel et al. | 211/126.16 |
| 2010/0181273 | A1 * | 7/2010 | Nagel et al. | 211/162 |
| 2010/0199696 | A1 * | 8/2010 | Nagel et al. | 62/255 |

* cited by examiner

PRODUCT DISPLAY TRAY WITH PULL THROUGH FEATURE

CROSS-REFERENCE TO RELATED APPLICATIONS

The present application claims the benefit under 35 U.S.C. §119(e) of the U.S. Provisional Patent Application Ser. No. 61/228,051, filed on Jul. 23, 2009, the content of which is incorporated herein by reference. The present application is also related in subject matter to our co-pending application Ser. No. 12/354,366, filed Jan. 15, 2009.

FIELD OF THE INVENTION

The invention relates to product display trays, particularly for the display of packaged sandwich meats and the like sold in blister packs.

BACKGROUND OF THE INVENTION

In the store display of small product items, it is a common practice to provide display trays arranged to receive a plurality of product items in a front-to-back column, with a spring actuated pusher paddle at the back of the column arranged to automatically move the column forward each time a product item is removed from the front of the display. This makes for a more sales-attractive display, by keeping the merchandise always available at the front of the display where it is easily seen and easily removed.

In the case of some products, such as packaged sandwich meats, for example, the product (e.g., a plurality of slices of sandwich meat) is received in a plastic blister pocket, typically of cylindrical shape, which is mounted on a back panel, also typically of plastic material, forming a sealed package. Frequently, such packages are recessed in the back, such that adjacent packages will nest to some degree. Products of this type tend to be difficult to handle in typical push-forward type display trays because the nesting of adjacent packages, coupled with limited overhead spaces, makes the normal upward removal of a package difficult or impossible. Accordingly, it is known to provide such trays with a package supporting and dispensing frame at the front end of the tray, which allows the product-containing pocket to project through the frame, while restraining the somewhat larger back panel of the package. Customers can extract packages from these displays by gripping the forwardly projecting pocket and pulling forward. The back panel of the package, which is somewhat flexible, flexes sufficiently to allow it to pass through the opening in the frame and be removed by the customer. The remaining column is then moved forward by the pusher paddle until the back panel of the front package is engaged and restrained by the frame while the pocket projects forwardly through the frame, ready for the next customer.

A known form of dispensing frame for display trays of the type described has side portions, which extend generally vertically along both sides of the package back panel, and an upper portion connecting upper ends of the side portions. These frame elements engage a package back panel adjacent to its top and side edges while allowing its blister portion to project forwardly through the frame. A shortcoming of this arrangement is that it requires the package to be gripped by its circular blister, in order to pull the package through the frame. This may be difficult for some customers.

Another problem with known display trays of the type mentioned above is that, whenever a customer removes a package and then changes his or her mind (a not-infrequent occurrence), dealing with the removed but unwanted package presents a problem. There may or may not be space to set it on top of the display, depending on what displays or structures there may be directly over head. In the end, the customer may just place the package in an improper location, wherever space can be found.

SUMMARY OF THE INVENTION

In accordance with one aspect of the invention an improved form of display tray is provided, for packaged sandwich meats and the like, which incorporates a novel and improved form of package-retainer, arranged to engage opposite side edge margins of the package back panel while allowing blister portion to project forwardly at the front of the display. The top of the package back panel is not restrained and is free to be engaged by a customer's hand. A customer desiring to extract a package from the display thus can grip the unrestrained upper portions of the package and pull forwardly. The normally restrained lower side edge portions of the package back panel are easily deflected and enabled to pass through the retainer and removed by the customer. The ability of the customer to engage and pull forward on the top of package makes the package removal process much easier than gripping the package by its forwardly projecting blister and pulling the margins of the package through a more conventional retaining frame.

In a particularly advantageous form of the invention, package retainer elements formed integrally and in one piece with forward portions of spaced apart wire side guide elements which extend longitudinally on each side of the display tray for lateral confinement of the packages. The wire side guide elements define guide planes for lateral confinement of a front-to-back column of packages. At their forward ends, the wire side guide elements are bent downwardly, preferably in a generally vertical plane, and portions thereof are displaced laterally inward to engage opposite side edge portions of the back panel of the forwardmost package on the tray. These downwardly and inwardly bent portions thus form a retainer for the forwardmost package of a column. The extent of inward displacement of the retainer portions is such as to allow the blister portion to project forward of the vertical plane of the retainer. To particular advantage, the inwardly displaced retainer portions extend inward and downward at a shallow angle to the vertical. Thus, when the front package is grasped by the upper portion of its back panel and pulled forward, the downwardly and inwardly angled wire retainer portions gradually deflect the package edges laterally and allow the package to be easily pulled through the retainer structure and withdrawn from the tray.

In another advantageous version of the tray, in which the side walls of the tray are formed of a rigid sheet material, an integral retainer structure is provided by the inward displacement of small retaining tabs of the sheet material near the front of the tray. The retaining tabs engage side edges portions of the back panel of the forwardmost package on the tray and form a retaining structure, while allowing the product-containing blister to project through. A package can easily be removed from the tray by gripping the upper edge of its back panel and pulling forward. As the upper portion of the package is tilted forward, the side edges thereof are displaced inwardly by the retaining tabs. This enables the package to be easily withdrawn from the tray by the customer, as desired.

In yet another embodiment of the new tray, where the tray is formed with laterally spaced side guides formed of sheet material, a package retaining structure is formed by a pair of retaining elements of inverted U-shaped configuration extending upward from the a bottom structure of the tray and positioned to engage opposite side edges of a package at the front of a front-to-back column thereof. The top of the front package is unobstructed and readily gripped by a customer desiring to extract the package. The customer pulls forward on the top of the package, causing the side edges of its back panel to be displaced inwardly by generously rounded upper ends of the retaining elements. This enables the package to be easily passed between the retaining elements and withdrawn by the customer. In accordance with the invention, the retaining elements are formed of wire into the desired inverted U-shaped configuration. The arrangement is such that the raw end of the wire is concealed and protected against, or closely adjacent to, the inside of the side guides, and the only exposed parts of the wire are the generously rounded upper end portions thereof.

In any of the forms of the invention, the package retaining elements are of a height to terminate well below upper edges of the package back panels and preferably below the tops of the blisters. The retaining elements thus engage package edges in central portions thereof. When a package is engaged by its unobstructed upper portion by a customer, the package can be easily pulled forward while its lower side wall portions are deflected inward for passage between the retaining elements.

Optionally, the retaining structure of the display tray, in any of its forms, can be spaced rearward of the front extremity of the tray, such that there is a space equal to at least one package thickness in front of the projecting blister portion of a retained, forwardmost package. Store keepers frequently desire to provide such a space because a customer may change his or her mind after extracting a package and need a place to return it. Returning an extracted package of this type to a position behind the retaining structure usually is difficult because of the typically nested character of the packages and because there may be little to no overhead clearance above the tray to enable the package to be returned. The extra space at the front allows a customer to return the package to the tray, as the new forwardmost item, where the package is adequately displayed and can easily be taken by the next customer.

For a more complete understanding of the above and other features and advantages of the invention, reference should be made to the following detailed description of preferred embodiments thereof and to the accompanying drawings.

DETAILED DESCRIPTION OF THE INVENTION

Figure 1:
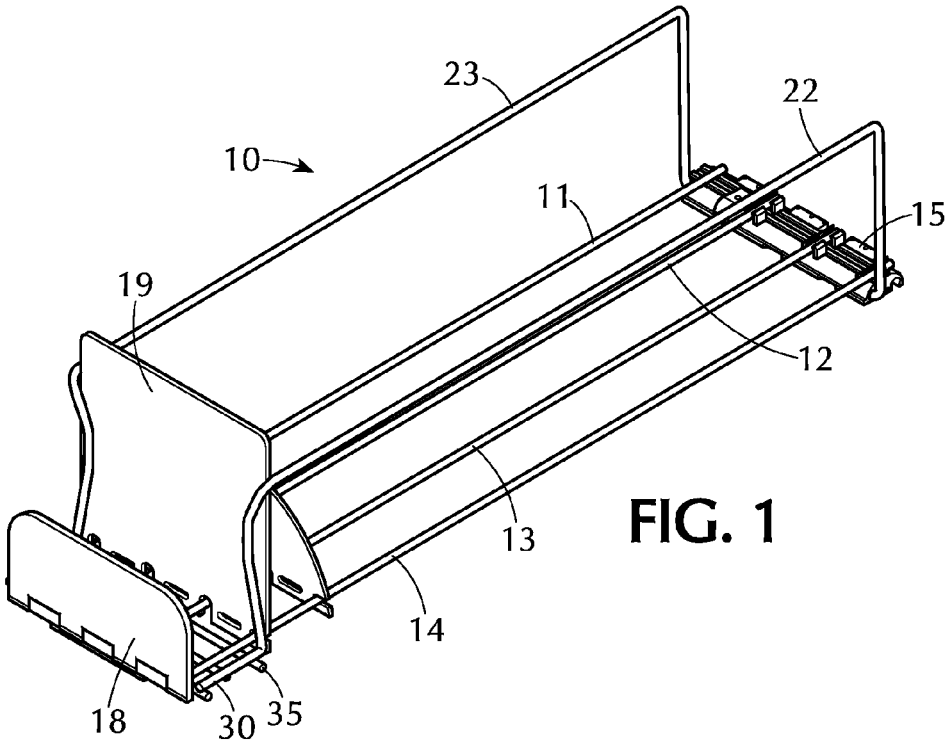
FIG. 1 is a front perspective view from above of a first embodiment of the product display device of the invention.
Figure 2:
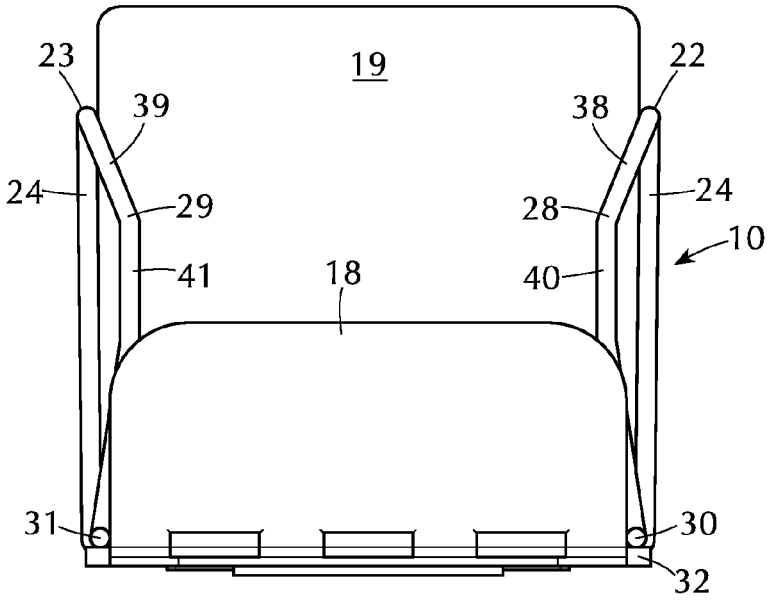
FIG. 2 is a front elevational view of the display device of FIG. 1
Figure 3:
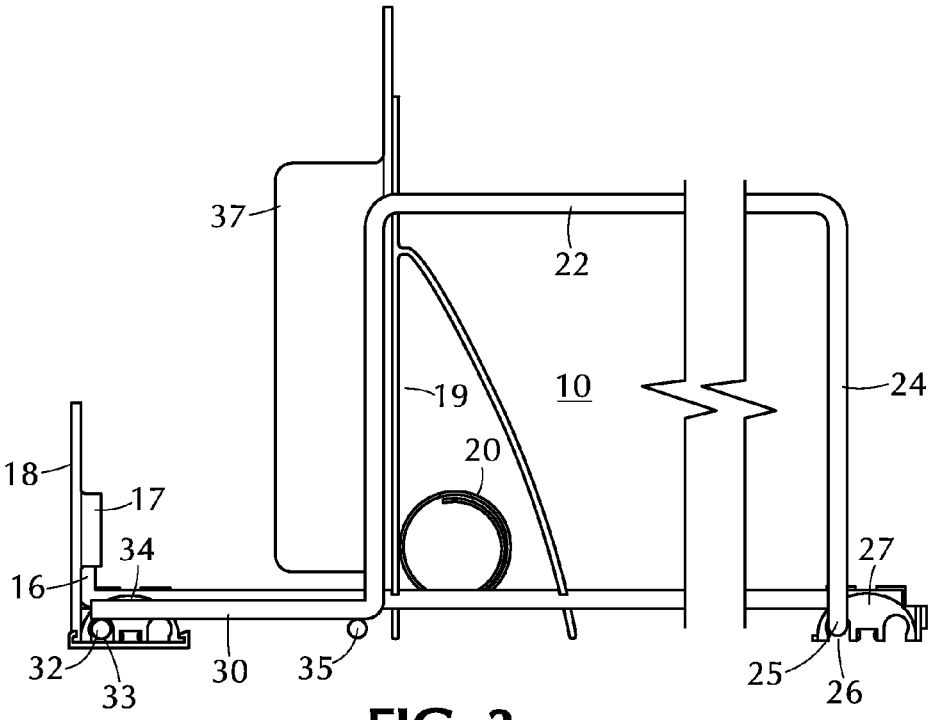
FIG. 3 is a side elevational view of the display device of FIG. 1

Referring now to the drawing, and initially to FIGS. 1-3 thereof, the reference numeral 10 designates generally a preferred form of product display tray in which the features of the invention are advantageously incorporated. Features of such display trays are shown in U.S. Pat. Nos. 6,745,906, 6,866,155, 6,866,700, 6,889,855 and 7,032,761, and the disclosures of these patents are incorporated herein by reference. In the illustrated form of tray, shown best in FIGS. 1 and 2, there is a tray base structure formed of four longitudinally extending wires 11-14. These longitudinally extending wires are joined at their back edges by a rear cross bar 15. At the forward end of the wire base structure there is a front cross bar (not shown) which is fixed to the forward ends of the two internal wires 12, 13 and is fixed to the outside wires 11, 14 adjacent the forwardmost end portions thereof. In the illustrated tray, the forward extremities 16 of the outer wires 11, 14 are bent upwardly and are arranged to be received in opposite side sockets 17 of a front barrier member 18, preferably formed of transparent or translucent material. The barrier member 18 serves as a front for the display rack, and also provides an outwardly facing surface for carrying labels and/or printed information identifying the product carried by the tray, its price, etc.

Mounted on the longitudinally extending wires 11-14 is a pusher paddle 19, which is slideable on the wires and is urged in a forward direction by a coil spring 20 anchored at the forward end of the tray, all as explained in the before mentioned patents. The paddle 19 can be moved to the back of the tray for loading the tray with product packages 21, and then constantly urges the packages forwardly as customers remove individual packages from the front of the display.

Although some of the trays disclosed in the above mentioned patents are of adjustable width to accommodate packages of different widths, the display trays of the invention are intended normally to be of fixed width and designed to accommodate packages of a particular predetermined width. To this end, side guide elements 22, 23 are formed of wire and extend longitudinally along opposite sides of the tray, spaced apart a distance to correspond to the width of the packages 21. The side guide elements 22, 23 are spaced above the level of the tray wires 11-14 a suitable distance to engage the package side edges well below the tops of the packages. The side guide elements are mounted at the backs thereof by integral vertical wire sections 24 which join at their bottoms with an integral, laterally extending connecting section 25. The section 25 is firmly seated in a downwardly opening groove 26 in a plastic base member 27, preferably by a upward snap-in motion. The wire side guides 22, 23 define parallel guide planes for lateral confinement of a front-to-back column of packages 21, which are urged forwardly by the paddle 19.

In a preferred form of the invention, the side guide elements 22, 23 extend forward to points spaced rearwardly a predetermined distance from the front barrier 18. At those points, retaining sections 28, 29, which are formed integrally and in one piece with the wire side guide elements, extend downward to a level at or below the level of the longitudinal tray wires 11-14 and there join with integral, forwardly extending sections 30, 31. At their forward extremities, the sections 30 31 are welded or otherwise fixed to a transverse cross bar 32, which is firmly seated in a downwardly opening groove 33 in a plastic front base member 34. A second cross bar 35 is welded or otherwise fixed to rear portions of the forwardly extending sections 30, 31 to fix the spacing between downwardly extending retaining sections 28, 29.

Figure 7:
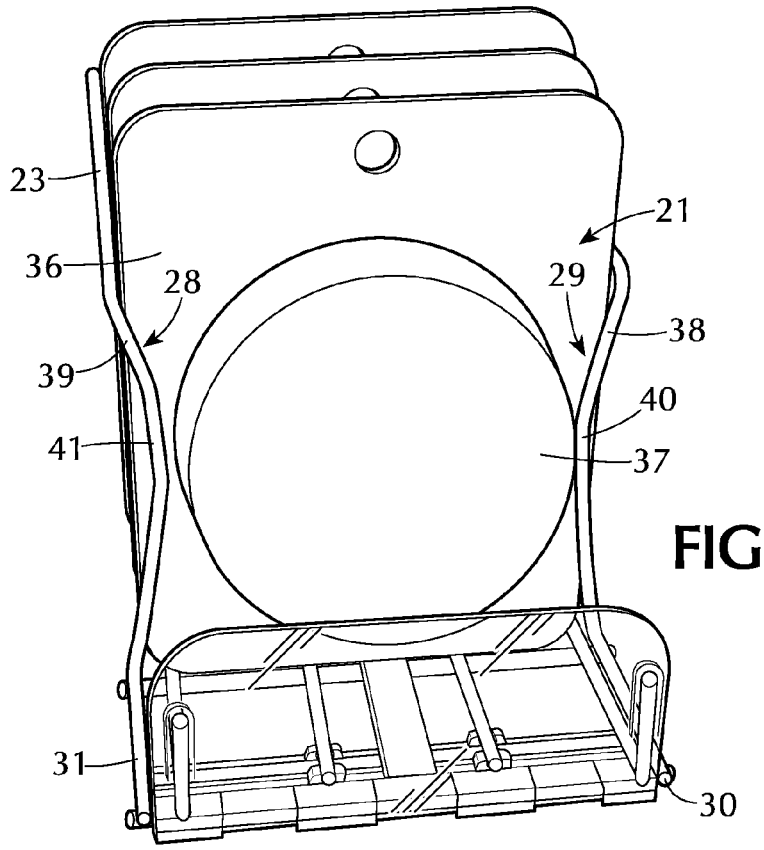
FIG. 7 is a front perspective view of a display device of FIGS. 1-3, illustrated with displayed packages

The trays forming the subject of this application are intended to handle product packages of the type shown in FIGS. 3 and 7, such as for sandwich meats and the like. The packages typically are provided with a generally rectangular back panel 36 formed of flexible plastic or paperboard and provided with a forwardly projecting blister 37, frequently cylindrical, for holding the sliced product. The back panel 36 is somewhat wider than the blister, as is evident is FIG. 7. Typically, such packages are formed with a recess (not shown) in the back to receive a short portion of the blister 37 of the package behind, so that a series of such packages stack in a nested relation.

Pursuant to the first illustrated embodiment of the invention, the side guide wires 22, 23 are spaced apart so as to closely but loosely confine the package panels 36 in front-to-back alignment in the tray, urged forwardly by the paddle 19. The integral wire retaining sections 28, 29 are shaped such that upper portions 38, 39 thereof angle downward and slightly inward to join with generally vertical intermediate portions 40, 41. Lower portions 42, 43 then angle slightly outward to join with the forwardly extending sections 30, 31. The upper, angled portions 38, 39, intermediate portions 40 41, and angled lower portions 42, 42 may be disposed generally in a common vertical plane. The arrangement, as shown in FIG. 7, is such that the intermediate portions 40 41 allow the blister 37 to project forwardly beyond the plane of the restraining sections 28, 29 while engaging and restraining the back panel 36 of the forwardmost package 21. Desirably, the restraining sections 28, 29 have a height less than the height of the back panels 36 and preferably slightly less than the top of the blister 37, as is evident in FIG. 7, such that upper portions of the back panels are open and unobstructed.

To remove a front package from the display, the back panel 36 is gripped at the top by a customer. Normally, even if there is sufficient clearance over the top of the display to enable the package to be withdrawn vertically, the nested relationship of the packages makes this very difficult, if not impossible. With the arrangement of the invention, however, the unobstructed upper portion of the panel 36 can be easily gripped by the customer and pulled forwardly to remove the package. As the upper portion of the back panel moves forwardly, its lower side edge portions are displaced rearwardly and inwardly, aided by a camming action of the inwardly angled wire sections 38, 39. After sufficient forward movement, of the package, the back panel 36 comes entirely free of the retaining elements 28, 29 and the freed package can be removed from the front of the display.

The positioning of the retaining sections 28, 29 behind the front barrier 18 must be sufficient to provide room for the package, with its forwardly projecting blister portion 37, to be displaced forward sufficiently to free the back panel 36 from the retaining elements. In addition, in the embodiment of the invention shown in FIGS. 1-3, the spacing between the retaining elements and the barrier 18 is such that the free space between the projection of the blister 37 and the barrier 18 preferably is at least equal to the overall thickness of a package and, in some cases, to the thickness of two packages. In this respect, a customer may remove a package from the display and then change his or her mind. It usually is not feasible for the customer to re-load the package into the display, behind the retaining elements. The "returned" package often is simply placed on any surface in the area that the customer can find, where it may not be adequately refrigerated and may have to be discarded by the storekeeper. However, with the embodiment of FIGS. 1-3, the space at the front of the tray, behind the barrier 18, is such as to enable a package to be easily returned to that space by the customer, so that the product package remains effectively displayed and salable to a subsequent customer.

Figure 4:
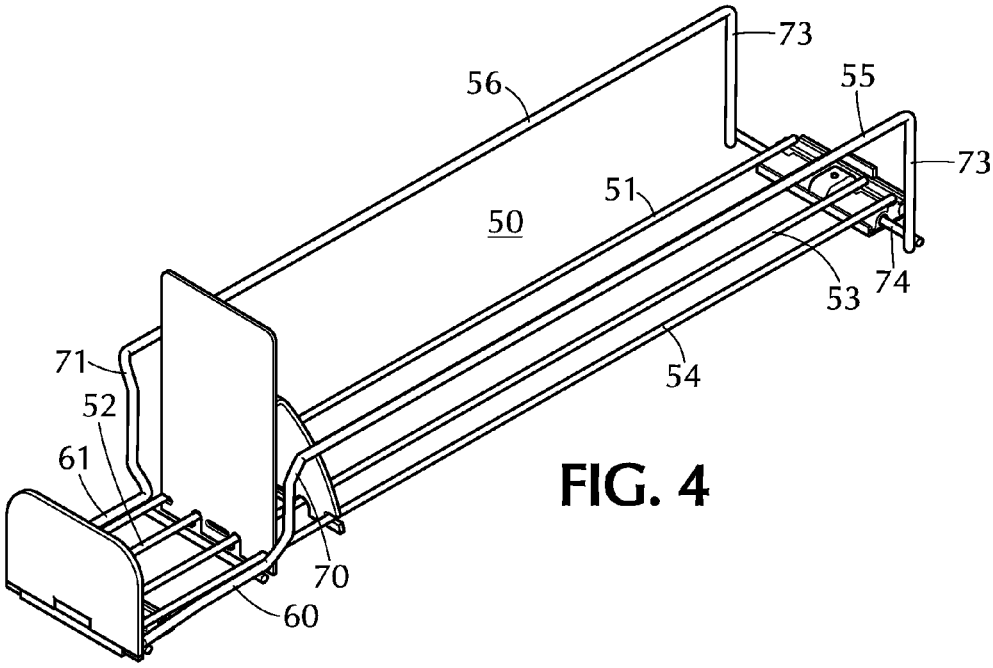
FIGS. 4-6 are front perspective, front elevational and side elevational views respectively of a second embodiment of the invention.
Figure 5:
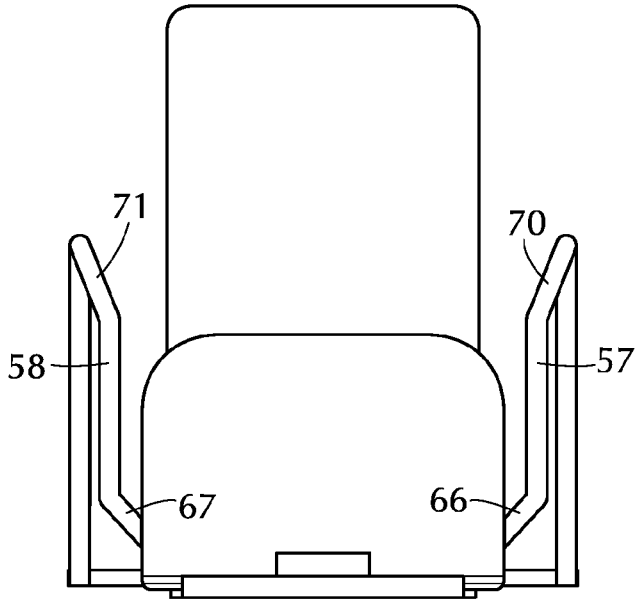
Figure 6:
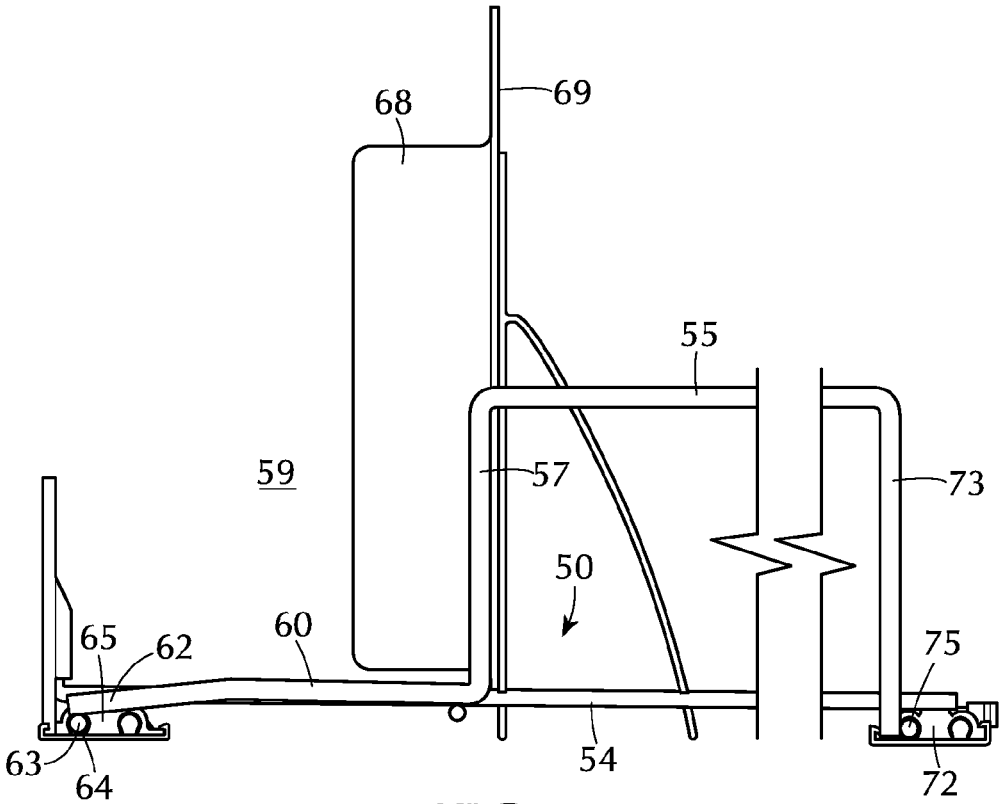

The embodiment of FIGS. 4-6 is similar in many of its functional aspects to the embodiment of FIGS. 1-3, but is suitable for the display and dispensing of somewhat narrower packages. Thus, whereas the tray of FIGS. 1-3 may accommodate packages of 5.25" in base width, with a blister diameter of about 4.375", the tray of FIGS. 4-6 is designed for package back panel widths of about 4.5" with a blister diameter of about 3.75".

In the embodiment of FIGS. 4-6, a principal tray structure 50, comprised of four longitudinally extending wires 51-54, is positioned on front and back plastic base members 65, 72. Longitudinal guide wires 55, 56 extend along opposite sides of the tray structure 50, spaced above the level of the wires 51-54, and define guide planes for the confinement of packages in a front-to-back column. The lateral spacing between the guide wires 55, 56 is just slightly greater than the width of packages to be displayed on the tray, and the height of the wires 55, 56 is such as to provide adequate lateral support for displayed packages but well below the tops thereof. At their back ends, the guide wires are joined with vertical supports 73, which are welded at their lower ends to a cross bar 74. The cross bar 74 is in turn gripped in a downwardly opening groove in the back base member 72, which serves to retain the tray structure 50 and side guides in a fixed relation.

At their forward ends, the side guide wires 55, 56 join integrally and in one piece with inwardly and downwardly angled portions 70, 71, which in turn integrally join with and form upper portions of generally vertically downwardly extending retaining sections 57, 58. The retaining sections integrally join at their lower ends with downwardly and inwardly extending sections 66, 67.

Packages of the general type shown in FIG. 6 are loaded onto the tray, supported on the tray wires 51-54 and confined in longitudinal alignment by the side guide wires 55, 56. The blister 68 of the forwardmost package projects between and beyond the retaining sections 57, 58, while the side edges of the back panel 69 are engaged and held by the retaining sections. The retaining sections 57, 58, including the angled upper portions 70, 71 thereof, are positioned along opposite side edges of the back panel 69 well below the upper portions thereof, and preferably below the top of the blister portion of the package, such that the upper portions of the back panel are exposed and unobstructed. To remove a package, the unobstructed upper portions of the panel are gripped by the customer and pulled forward. The side edges of the panel, in mid portions thereof, are initially restrained and displaced rearwardly, aided by inwardly angled upper portions 70, 71 of the retaining sections, enabling the package to be easily withdrawn forwardly from the display.

In the embodiment of FIGS. 4-6, the principal tray structure 50, comprising the four longitudinally extending wires 51-54, is relatively narrower than the spacing of the guide planes defined by the side guide wires 55, 56, and thus provides a somewhat less stable bottom support for product packages supported on the tray, as compared to the embodiment of FIGS. 1-3. While packages positioned behind the retaining sections 57 58 are confined and stabilized by the side guide wires 55, 56, packages selected and withdrawn by a customer and then returned to the space 59 in front of the retaining sections 57, 58 are not stabilized by the side guide wires. Accordingly, in the embodiment of FIGS. 4-6, forwardly extending wire sections 60, 61, at least in the back portion of the space 59, are positioned to be level with or slightly above the level of the tray wires 51-54, as can be seen in FIG. 6, to provide additional support and stability to outer edge portions of returned packages. The forward portions 62 of the wire sections 60 are angled downward slightly to crossbar 63, to which the wire sections are welded or otherwise fixed. The cross bar 63 is received and firmly retained in downwardly opening groove 64 in front base member 65.

A common advantageous feature of the embodiments of FIGS. 1-3 and 7 and that of FIGS. 4-6 is that the side guide wires and the retaining structure comprise a continuous wire form, with the front ends of the side guide wires joining integrally and in one piece with the downwardly and inwardly displaced retaining sections. This provides a neat-appearing and highly economical structure which at the same time has superior functionality for the purposes intended.

Figure 8:
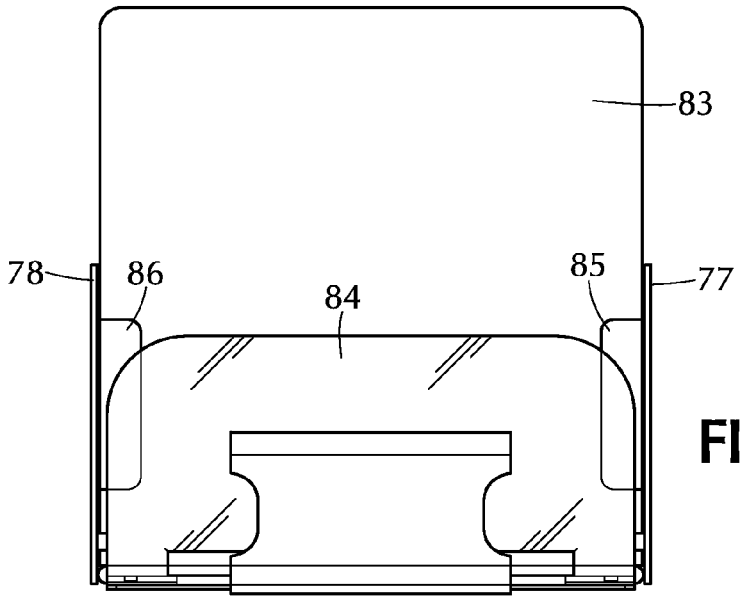
FIG. 8 is a front elevational view of a modified form of display device of the invention, adapted for cantilever mounting on a rectangular display bar.
Figure 9:
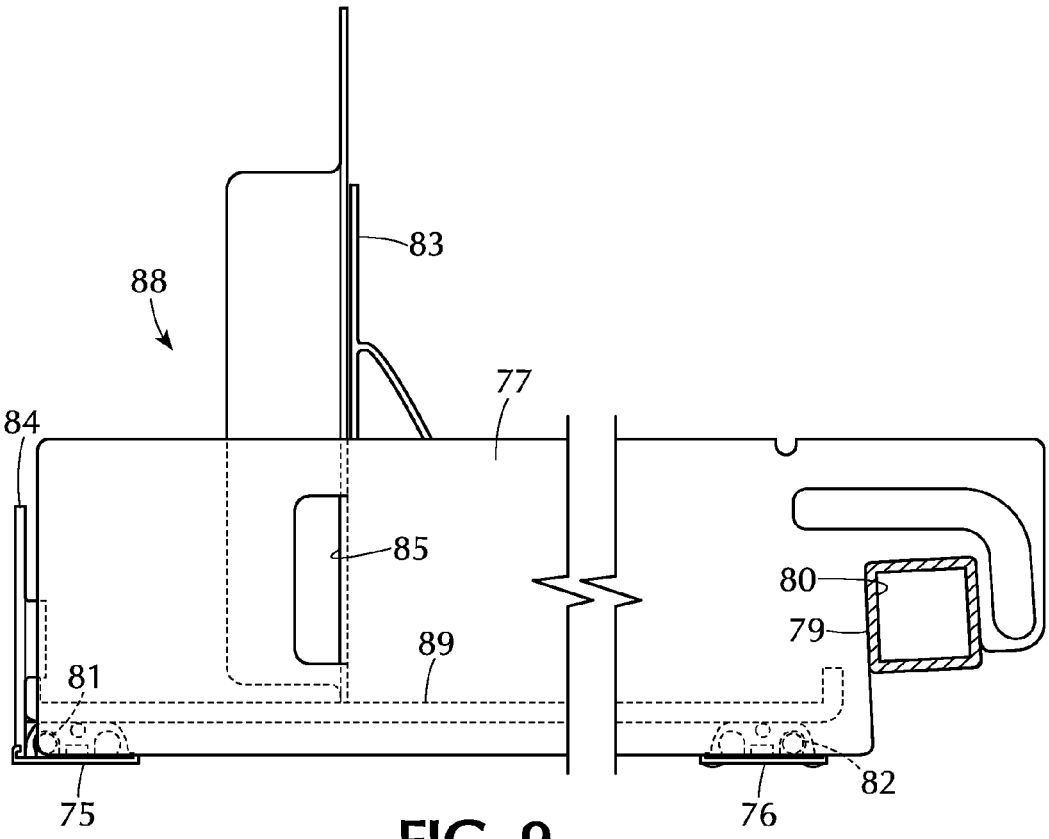
FIG. 9 is a side elevational view of the display device of FIG. 8.
Figure 10:
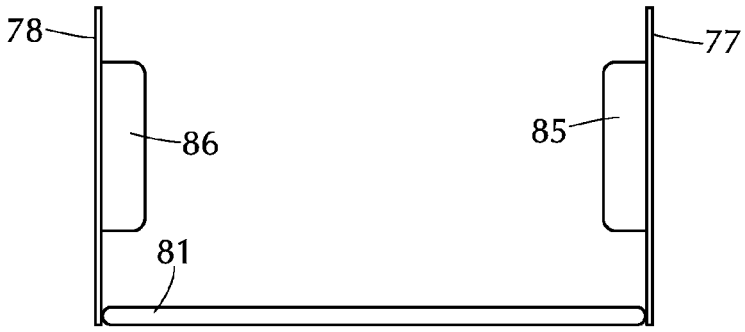
FIGS. 10 and 11 are front elevation and top plan views respectively of a side guide structure incorporated into the display device of FIG. 8.
Figure 11:
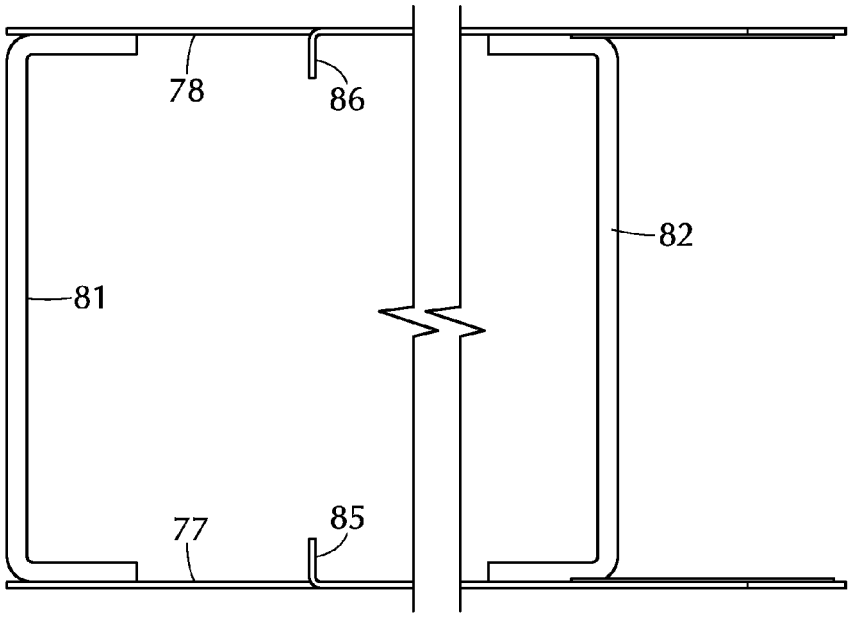

With reference now to the embodiment shown in FIGS. 8-11, there is shown a form of the display tray which is adapted for cantilever mounting on a display bar, generally in the manner described in our co-pending application Ser. No. 12/354,398, the disclosure of which is incorporated herein by reference. The tray structure includes a support tray formed of longitudinal wires 89 and front and back plastic bases 75, 76, as in the first described embodiments. Instead of using wires as side guides, as in the prior embodiments, this embodiment incorporates side panels 77, 78 formed of rigid sheet material, preferably sheet metal, and provided adjacent the back ends thereof with downwardly opening recesses 79 for the reception of a rectangular display bar 80, which serves to mount and support the tray. The side panels are secured in spaced apart relation by means of generally U-shaped cross bars 81, 82, which are welded or otherwise secured to lower edge portions of the side panels adjacent to front and back portions of the panels. Transverse portions of the cross bars are engaged with downwardly opening grooves in the tray bases 75, 76, substantially as described with reference to previous embodiments, such that the panel and crossbar assembly is joined with the underlying tray structure, including the pusher paddle 83 and front barrier panel 84, as shown in FIGS. 8 and 9.

Pursuant to the invention, the side panels are formed with integral, inwardly bent retaining tabs 85, 86, which can be punched from the material of the panel, between the upper and lower edges thereof, and bent inwardly along a generally vertical bend line. In the illustrated embodiment, intended for product packages having a back panel of around 5 inches in width and a projecting blister of slightly more than 4 inches in diameter, the side panels are spaced apart about 5.19 inches and the retaining tabs 85, 86 extend inward about 0.4 inch to provide a spacing between tabs of about 4.37 inches.

When the tray is loaded with a front-to-back column of product packages (not shown), all being urged forward by the spring actuated paddle 83, the back panel of the forwardmost package is engaged by its side edges, and the blister projects forwardly between the tabs 85, 86. The retaining tabs are located well below the tops of the package back panels and preferably well below the upper limits of the blister, as shown in FIG. 9. The upper edges of the package back panels are thus fully exposed and unobstructed. The forwardmost package thus can be readily gripped and pulled forward as the panel side edges flex rearwardly, as previously described, until the package is pulled free of the display. The rounded upper corners 87 of the tabs 85, 86 tend to facilitate the rearward deflection of the panel edges. If desired, the upper portions of the tabs 85, 86 may be differently shaped (e.g., somewhat tapered) to provide a more gradual deflection of the package edges as the top of the package is pulled forward.

In the embodiment of the invention illustrated in FIGS. 8-11, the retaining tabs are located a predetermined distance behind the front barrier 84, not only to accommodate forward pulling of the package, but also enable return of one and perhaps two packages to the front space 88, to accommodate circumstances where a customer has extracted a package and then had a change of mind. In the illustrated embodiment, approximately 3 inches of front space is provided. By locating the retaining tabs 85, 86 well behind the front edges of the side panels 77, 78, forward portions of the side panels serve to enclose the sides of the front space 88 for lateral confinement of packages returned thereto.

Figure 12:
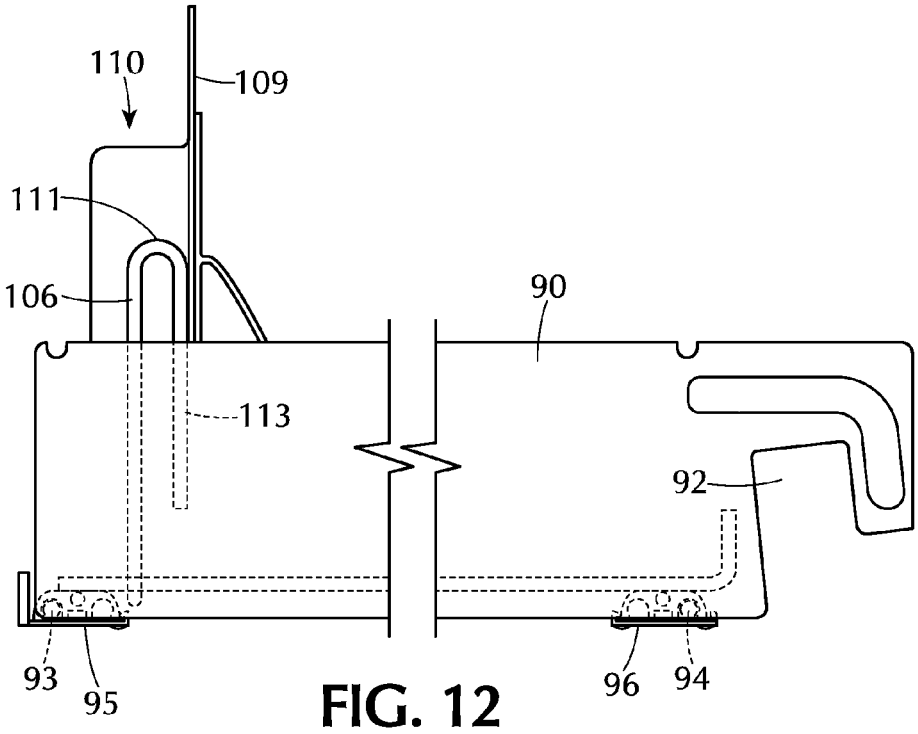
FIG. 12 is a side elevational view of a modified form of the display device of the invention, which is similar to the device of FIGS. 8-11 but utilizes a different form of retainer structure.
Figure 13:
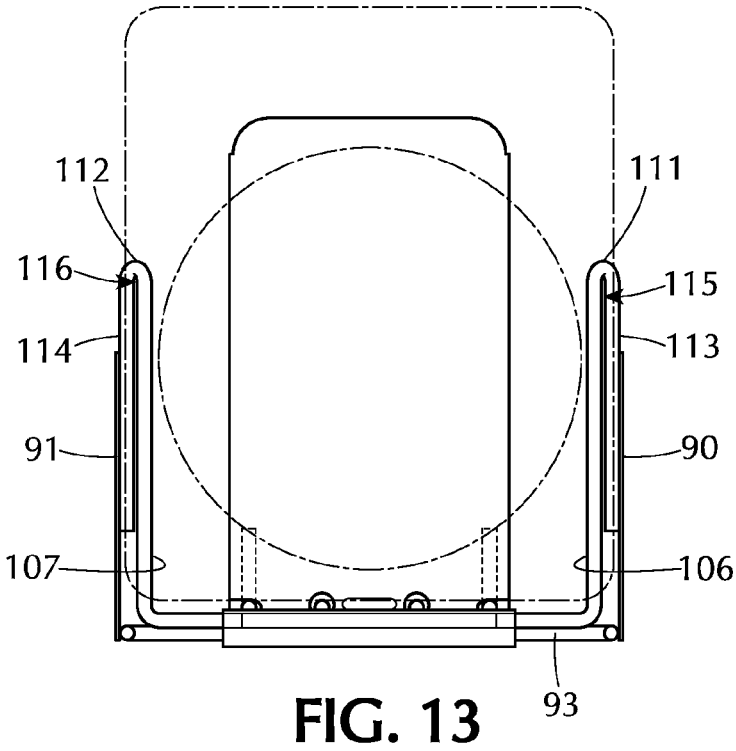
FIG. 13 is a front elevational view of the display device of FIG. 12.
Figure 14:
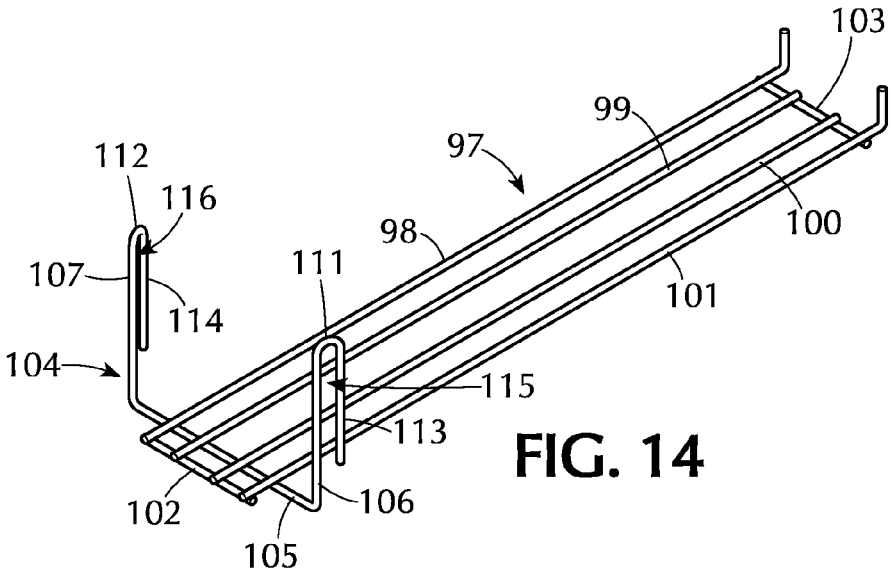
FIG. 14 is a front perspective view of a wire base structure incorporated in the display device of FIG. 12.

The embodiment shown in FIGS. 12-14 is similar in some respects to that of FIGS. 8-11, in that opposite side walls 90, 91 thereof are formed of rigid sheet material and are provided at the back ends thereof with downwardly opening recesses 92 for the reception of a rectangular display bar (not shown). The two side walls 90, 91 are secured in spaced apart relation by front and back cross bars 93, 94, similar to the cross bars 81, 82 of FIG. 11, which are secured in downwardly facing grooves in front and back plastic base members 95, 96.

Positioned between the side walls 90, 91 is a tray structure 97, comprised of a plurality of longitudinally extending wires 98-101 joined at opposite ends by cross bars 102, 103. The cross bars are received in upwardly opening grooves in the base members 95, 96, such that the stray structure is secured in fixed relation to the side walls 90, 91.

Pursuant to one aspect of the invention, embodiment of FIGS. 12-14 incorporates a modified form of package retaining device 104, The retaining device is in the form of a U-shaped section of wire, comprised of a bottom section 105 positioned underneath and welded or otherwise secured to the longitudinal tray wires 98-101, and upwardly extending, laterally spaced apart retaining elements 106, 107. In the illustrated structure, the retaining elements 106, 107 project somewhat above the upper edges of the side walls 90, 91 but terminate well below the upper edge 108 of the back panel 109 of blister package 110, and preferably below upper portions of the blister itself. At their upper extremities, the retaining elements 106, 107 are formed with reverse bends 111, 112, joining with downwardly extending wire sections 113, 114, forming retaining sections 115 116 of generally inverted U-shaped configuration. The downwardly extending sections 113, 114, are positioned close to and preferably in contact with inner surfaces of the side walls 90, 91, as shown in FIG. 13. This arrangement assures that the cut-off wire ends of the retaining sections are both concealed from view, for aesthetic purposes, and protected against contact by, and possible injury to, customers and store personnel.

Desirably, the respective retaining sections 115, 116 are disposed in planes oriented at an angle (e.g., 45°) to the planes of the side walls 90, 91. The arrangement is such that the retaining sections form a convergent passage for the blister packages, with the blister portions thereof projecting forward of the retaining sections and the back panels being retained thereby.

To remove a package from the tray of FIGS. 12-14, the exposed and unobstructed upper edges of the back panel are gripped and pulled forward. The restrained but flexible side edges of the back panel are deflected rearwardly by the retaining sections 115, 116, but the package allowed to pass between them, generally as hereinbefore described.

The embodiment of FIGS. 12-14 differs from the others in that is does not provide for a front space for a customer to return a package after withdrawing it through the retaining elements and then having a change of mind. Some vendors prefer to utilize that space to provide for loading of more product packages into the tray. The option of providing for front space, or not, is one of spacing of the retaining elements, so the particular wishes of different vendors are easily accommodated.

In any of its forms, the display tray of the invention greatly facilitates the customer removal of packages, such as blister packages for luncheon meats and the like. The trays incorporate advantageous forms of retaining elements that engage side edges of the package while leaving the upper portions thereof exposed and unobstructed and thus easily grasped and pulled forward by the customer to enable the package to be easily removed from the tray. More conventional forms of such trays commonly utilize enclosed frames for retention of the forwardmost package. This makes it very inconvenient (if possible at all) to grip the upper edge of the package, and customers normally grip and pull on the blister portion of the package in order to remove it. Elderly people and people with small hands may find it very difficult to pull a package from the display by gripping its blister portion. Gripping the top of the package, on the other hand, is very easy, and the tilting forward of the package provides a gradual and progressive displacement of the package edges, which requires less force than pulling on the package by its center portion. This action is enhanced where the upper portions of the retaining elements are disposed at a downward and inward angle, as for example in the embodiments of FIGS. 1-7.

In the embodiments of FIGS. 1-11, the retaining elements are formed integrally and in one piece with the side guide wires (FIGS. 1-7), or side walls (FIGS. 8-11) of the tray. This provides for a particularly simplified and economical manufacture of the trays. In the embodiment of FIGS. 12-14, the retaining elements are simple wire elements of inverted U-shaped configuration which, while separate from the side guide elements are incorporated into the structure of the product support tray. The inverted U-shaped configuration of the retaining elements 115, 116 provides for concealment of and protection from the raw cut ends of the wires of which they are formed. At the same time, the inverted, U-shaped tops of the retaining elements provides a transition surface for rearward flexing of the back panels of packages as they are removed from the display. In all cases, the retaining elements extend only along and part way up the sides of the product package, with no part thereof extending across the top of the tray. As a result, the top portions of the forwardmost package is always exposed and unobstructed for easy removal by the customer.

While the illustrated embodiments are representative of the certain aspects of the invention, they are not intended to reflect all the forms the invention may take within the clear teachings of the disclosure. Accordingly, reference should be made to the following appended claims in determining the full scope of the invention.

What is claimed is:

1. A tray for the display and dispensing of products in blister packages comprised of back panels formed of flexible material and product-containing blisters projecting forward from said back panels and with side portions of said blisters spaced inward from side edges of said back panels to form engageable side margins of the back panels, the tray comprising (a) an elongated support structure forming a bottom support for a plurality of generally vertically oriented blister packages arranged in a front-to-back column, (b) laterally spaced apart side guide elements positioned on opposite sides of said support structure substantially throughout the length thereof and engageable with opposite side edges of said package back panels to maintain said packages in said front-to-back column arrangement, (c) said side guide elements comprising generally flat, vertically oriented side walls formed of rigid sheet material spaced apart a predetermined distance slightly greater than a width of said package back panels and defining guide planes on opposite sides of said support structure for lateral confinement of said packages, (d) a resiliently actuated pusher element engageable with a backmost package of a column thereof and operative to urge the column of packages forward as individual packages are removed from the tray, (e) package retaining elements positioned adjacent a front end of said support structure, on opposite sides thereof, for engaging and restraining the engageable side margins of the back panel of a forwardmost package in said column thereof while enabling the blister portion of said forwardmost package to project forwardly between said package retaining elements, (f) said package retaining elements each being formed of wire and having an inverted U-shaped configuration, (g) upwardly extending first portions of said package retaining elements being spaced apart a distance greater than a width if said package blister portions and less than a width of said back panels, (h) said package retaining elements having second portions, forming the tops thereof, of substantially semi-circular configuration positioned substantially below upper edges of said back panels, (i) said package retaining elements having third portions extending downward from said semi-circular second portions and positioned closely adjacent to inner surfaces of said side walls.

2. A tray according to claim 1, wherein (a) said semi-circular second portions of said package retaining elements being positioned at a level above upper edges of said side walls.

3. A tray according to claim 2, wherein (a) said semi-circular second portions are positioned at a level below uppermost portions of the blister portion of a forwardmost package engaged by said retaining elements.

4. A tray according to claim 2, wherein (a) the downwardly extending third portions of said package retaining elements being positioned rearwardly of the first portions thereof, whereby said first, second and third portions of said retaining elements lie in planes disposed convergently with respect to a forwardmost package retained thereby.

5. A tray according to claim 2, wherein (a) lower ends of said first portions of said package retaining elements being connected by and integrally joined with a transverse wire extending under said elongated support structure.

6. A tray according to claim 5, wherein (a) said support structure comprises a plurality of laterally spaced apart longitudinal wire elements, and (b) said transverse wire extends under and is welded to wires of said support structure.

* * * * *